US008035043B2

(12) United States Patent
Asada

(10) Patent No.: US 8,035,043 B2
(45) Date of Patent: Oct. 11, 2011

(54) MULTIDIRECTIONAL SWITCH

(75) Inventor: Makoto Asada, Yao (JP)
(73) Assignee: Hosiden Corporation, Osaka (JP)

( * ) Notice: Subject to any disclaimer, the term of this patent is extended or adjusted under 35 U.S.C. 154(b) by 377 days.
(21) Appl. No.: 12/355,174
(22) Filed: Jan. 16, 2009
(65) Prior Publication Data

US 2009/0183978 A1 Jul. 23, 2009

(30) Foreign Application Priority Data

Jan. 21, 2008 (JP) ..... 2008-010706

(51) Int. Cl.
*H01H 19/00* (2006.01)
(52) U.S. Cl. ..... 200/6 A
(58) Field of Classification Search ..... 200/6 A, 200/5 A, 5 R, 7, 61.27, 4, 186 A, 6 R, 17 R, 200/18, 14
See application file for complete search history.

(56) References Cited

U.S. PATENT DOCUMENTS

| | | | | |
|---|---|---|---|---|
| 6,124,555 | A * | 9/2000 | Isikawa | 200/4 |
| 6,570,107 | B1 | 5/2003 | Nishimoto et al. | |
| 6,720,504 | B2 * | 4/2004 | Nishimoto et al. | 200/4 |
| 2009/0050465 | A1 | 2/2009 | Asada | |

FOREIGN PATENT DOCUMENTS

| | | | |
|---|---|---|---|
| DE | 10049111 | A1 | 6/2001 |
| EP | 1764814 | A1 | 3/2007 |
| JP | 57-034931 | U | 2/1982 |
| JP | 57-170102 | U | 10/1982 |
| JP | 08115641 | A | 5/1996 |
| JP | 11073854 | A | 3/1999 |
| JP | 3896734 | B2 | 4/2001 |
| JP | 2007227006 | | 6/2007 |

* cited by examiner

*Primary Examiner* — Edwin A. Leon
(74) *Attorney, Agent, or Firm* — The Webb Law Firm

(57) ABSTRACT

A pressure-receiving member that can be moved along an urging axial center, and a compression coil spring for urging the pressure-receiving member in the direction of an engaging body, are provided between the engaging body in an inside end position of an operating rod and a bottom wall part of a casing. A plurality of protruding pieces for restricting tilting by making contact with the pressure-receiving member is provided to the internal surface of a cylindrical part of a rotor that engages and integrally rotates with engaging pieces of the external periphery of the engaging body.

9 Claims, 7 Drawing Sheets

MULTIDIRECTIONAL SWITCH

BACKGROUND OF THE INVENTION

1. Field of the Invention

The present invention relates to a multidirectional switch provided with a tilt detector for electrically detecting a tilting operation of an operating rod supported in a casing, a pressing detector for electrically detecting a pressing operation of the operating rod in a direction along an axial center, and a rotation detector for electrically detecting a rotational operation of the operating rod.

2. Description of the Related Art

A multidirectional switch configured in the manner described above is disclosed in Patent Document 1. In Patent Document 1, an acting body is fitted onto an intermediate position of the operating rod. When subjected to pressure, any one of four units formed on the acting body produces a pressing action and causes a spring plate member to elastically deform in a corresponding position in a case in which the operating rod is tiltably operated. A tilt detector is configured so that the tilting operation is electrically detected by the contact of the spring plate member with a corresponding electrode.

Also, in patent document 1, a contact part is protrudingly formed in a lower end position of the operating rod, and the contact part presses and causes the spring plate member to elastically deform when the operating rod is operated to create pressure in the direction of the axial center of the rod. The spring plate member makes contact with a corresponding electrode, whereby the pressing detector is configured to electrically detect the pressing operation. In particular, a ring-shaped spring seat member is provided in a position that encompasses the contact part, and a compressed coil-type return spring is provided between the spring seat member and the bottom wall of the case.

Further provided in Patent Document 1 are a cylindrical part for engaging a plurality of engagement pieces formed in the shape of a gear on the lower part of the operating rod, and a rotor having a flange-shaped part integrally formed at the lower end part of the cylindrical part. The rotor integrally rotates with the operating rod, and a rotation detector is configured so that the rotation is electrically detected by a contact between a sliding contact part of the lower surface of the flange-shape part and a plurality of electrodes formed on the bottom surface of the case when the operating rod rotatably operates.

[Patent Document 1] JP (Kokai) 2007-227006 (paragraphs [0020] to [0054], and FIGS. 3 to 11)

SUMMARY OF THE INVENTION

The return spring of the multidirectional switch described in Patent Document 1 functions to apply an urging force in the return direction of the operating rod in a case in which the operating rod is subjected to pressure along the direction of the axial center of the rod, and also functions to apply a force for restoring the operating rod to a neutral orientation in a case in which the operating rod has been tiltably operated.

In the multidirectional switch described in Patent Document 1, the urging force that acts on the operating rod from the return spring causes a radial location of the return spring to be compressed and an oppositely disposed location to be extended when the operating rod is tiltably operated, as shown in FIG. 6 of Patent Document 1.

In a case in which the return spring is non-uniformly compressed by a biased load in such a manner, an urging force that acts in the neutral direction on the operating rod is reduced because the urging force acts in a direction away from the axial center of the return spring (a virtual straight line that connects the center of a circle formed by the coil).

In other words, when the operating rod has been tiltably operated, an urging force is generated in a compressed location of the return spring, but since the spring seat member tilts toward the axial center of the return spring, the urging force acts in the direction along the tilt plane of the spring seat member, and the restorative force that acts on the operating rod is reduced.

In particular, improvements can still be made in a case in which the urging force of the return spring acts in the direction along the tilt plane of the spring seat member in the manner described above in accompaniment with the tilting operation of the operating rod. In this case, the urging force acts in the direction in which the return spring itself is allowed to move; as a result, the return spring is displaced between the bottom surface of the casing and the spring seat member midway through the tilting operation of the operating rod, and the direction of the urging force that acts on operating rod changes, making the switch less convenient to operate.

An object of the present invention is to optimize a multidirectional switch in which a suitable urging force is applied to the operating rod even in a case in which the operating rod has been tiltably operated.

A first aspect of the multidirectional switch of the present invention for achieving the above-described object is a multidirectional switch provided with a tilt detector for electrically detecting a tilting operation of an operating rod supported in a casing, a pressure detector for electrically detecting a pressing operation of the operating rod in a direction along an axial center, and a rotation detector for electrically detecting a rotational operation of the operating rod, the multidirectional switch comprising:

an urging member for applying an urging force to the operating rod along an urging axial center that is coaxial with the axial center of the operating rod in a neutral orientation in the direction of the tilting operation; and a pressure-receiving member caused to make contact with an inside end part of the operating rod inside the casing by the urging force from the urging member, wherein the pressure-receiving member has a tilt limit during the tilting operation of the operating rod.

In accordance with the present configuration, the tilting limit of the pressure-receiving member is set even in a case in which the operating rod is tiltably operated, a location on the external peripheral part of the inside end of the operating rod is displaced in the direction in which the urging member is compressed, and the other locations of the external peripheral part of the inside end of the operating rod are displaced in the direction that extends the urging member. Therefore, a situation can be prevented in which a location of the pressure-receiving part that corresponds to the position in which the urging member extends is considerably displaced in the direction of the operating rod, and the orientation of the pressure-receiving member can be kept in an orientation approximate to an orientation orthogonal to the urging axial center. Since the tilt limit of the pressure-receiving member is set in this manner, the pressure-receiving member and the operating rod are in contact with each other at the pressing side, but move away from each other at the other side of the pressing side in a case in which the operating rod is tiltably operated. Therefore, only the urging force of the urging member from the contact locations operates on the operating rod, and the restorative force of the operating rod is increased. The configuration results in a multidirectional switch that suitably exerts an urging force on the operating rod when the operating rod is tiltably operated.

A second aspect of the multidirectional switch of the present invention is one in which protruding pieces are provided for setting the tilt limit by making contact with the pressure-receiving member.

In accordance with the present configuration, the tilt limit of the pressure-receiving member can be set by a simple structure provided with protruding pieces that make contact with the pressure-receiving member.

A third aspect of the multidirectional switch of the present invention is one in which the rotation detector has a rotor for rotating in accompaniment with the operating rod, and a plurality of electrodes for detecting the rotational position of the rotor; the rotor has a cylindrical part capable of engaging and integrally rotating with the external periphery of an inside end part of the operating rod; the urging member and the pressure-receiving member are arranged inside the cylindrical part; and the protruding pieces are formed on the internal surface of the cylindrical part.

In accordance with this configuration, a member for providing protruding pieces is not specially formed, and the tilt limit of the pressure-receiving member can be set without increasing the number of components by using the cylindrical part of the rotor.

A fourth aspect of the multidirectional switch of the present invention is one in which the pressure detector has a spring plate member made of a conductor elastically deformed by the effect of a pressing force produced by the operation of the operating rod in an inward pressing direction, and also has a pair of electrodes energized by contact with the spring plate member when the spring plate member undergoes elastic deformation; the urging member is made of a compression coil spring; and the compression coil spring is arranged in a position that encompasses the spring plate member.

In accordance with the present configuration, a pressing operation can be detected by contact between the spring plate member and the electrode in a case in which the operating rod has been operated by pressure along the axial center of the rod. When the operating rod has been tiltably operated, the pressure-receiving member displaces in accompaniment with the tilt, and the compression coil is compressed. Therefore, the urging force that acts on the pressure-receiving member from the compressed coil spring can be made to act in the direction that restores the operating rod to a neutral orientation.

A fifth aspect of the multidirectional switch of the present invention is one in which the tilt detector has elements arranged in positions encompassing the operating rod, the elements comprising: an acting body for integrally tilting with the operating rod; a spring plate member made of a conductor elastically deformed by the effect of a pressing force produced by the acting body; and a pair of electrodes energized by contact with the spring plate member when the spring plate member undergoes elastic deformation.

In accordance with the present configuration, the corresponding spring member and electrode make contact when the operating rod is tiltably operated, whereby the direction of the tilting operation can be electrically detected.

DESCRIPTION OF THE PREFERRED EMBODIMENTS

Embodiments of the present invention will be described below with reference to the diagrams.

(Overall Configuration)

The multidirectional switch has an operating rod 20 oriented vertically in relation to a casing 10, a tilt detector A for electrically detecting a tilting operation of the operating rod 20, a pressure detector B for electrically detecting a pressing operation of the operating rod 20 in the direction along the axial center Y, and a rotation detector C for electrically detecting a rotational operation of the operating rod 20, as shown in FIGS. 1 to 4.

Figure 1:
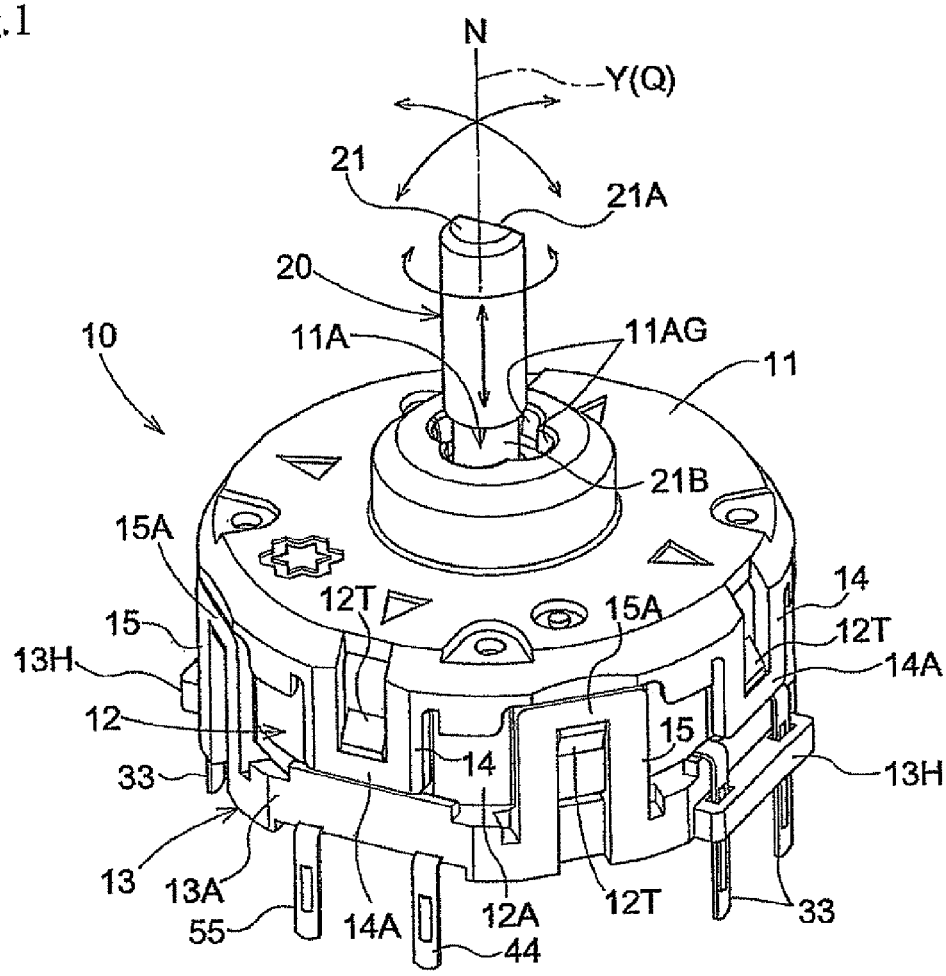
FIG. 1 is a diagram showing a perspective view of the multidirectional switch.
Figure 2:
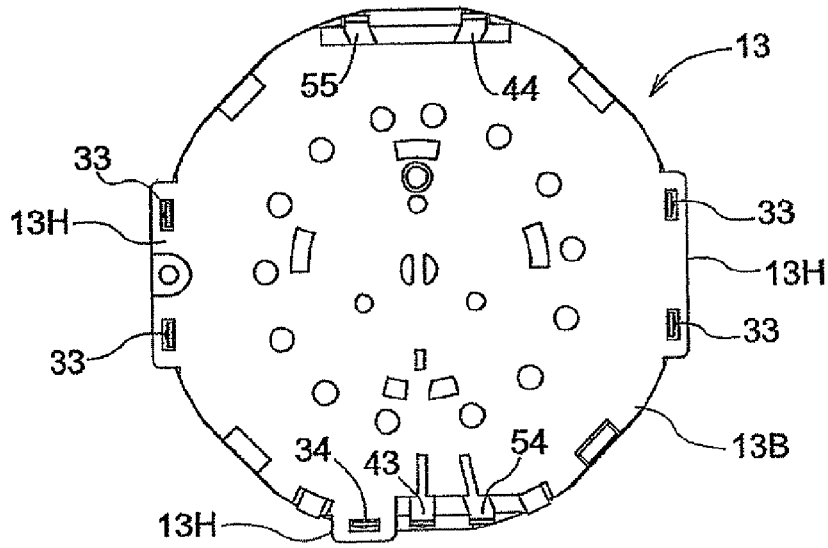
FIG. 2 is a diagram showing a bottom view of the multidirectional switch.
Figure 3:
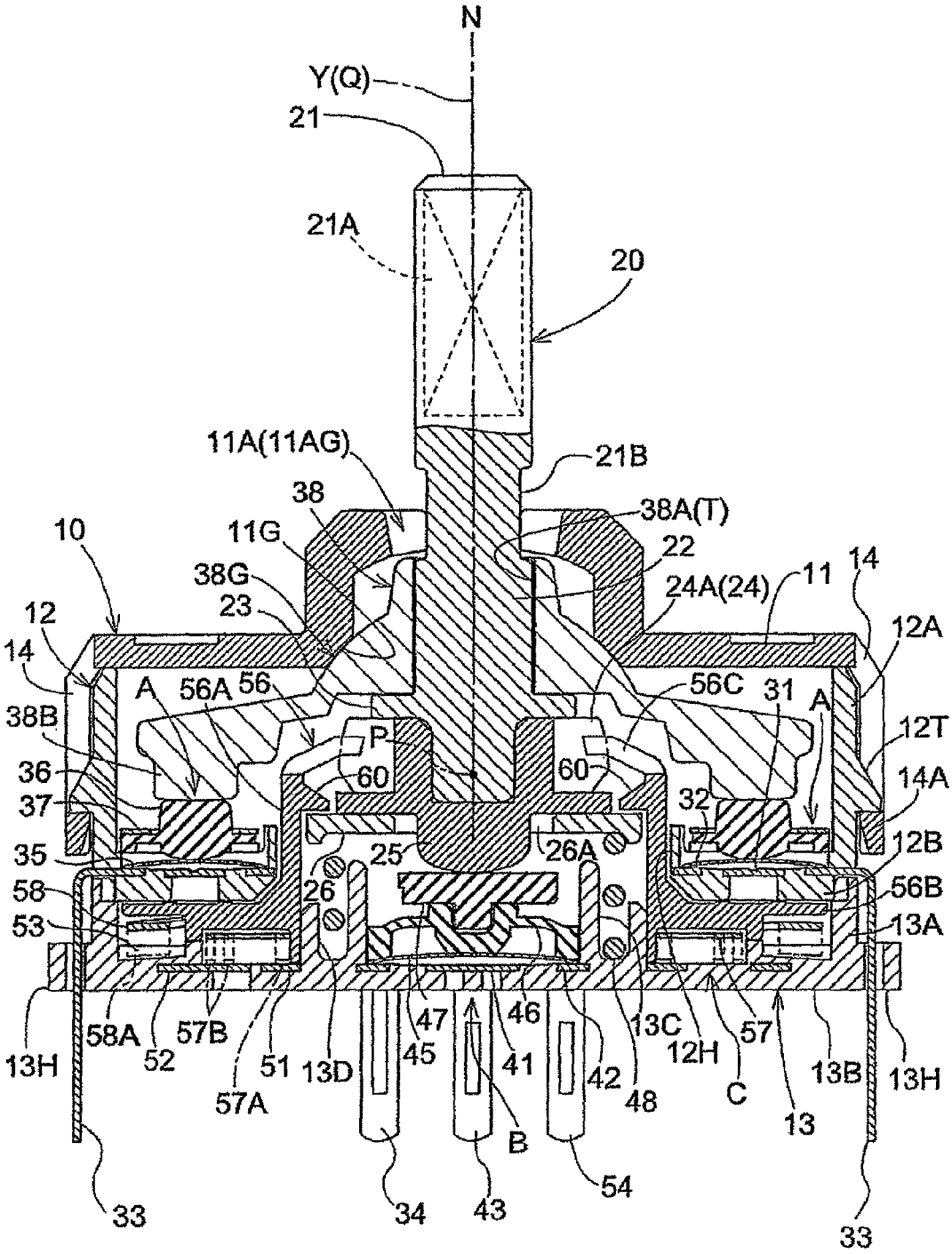
FIG. 3 is a diagram showing a longitudinal sectional view of the multidirectional switch.
Figure 4:
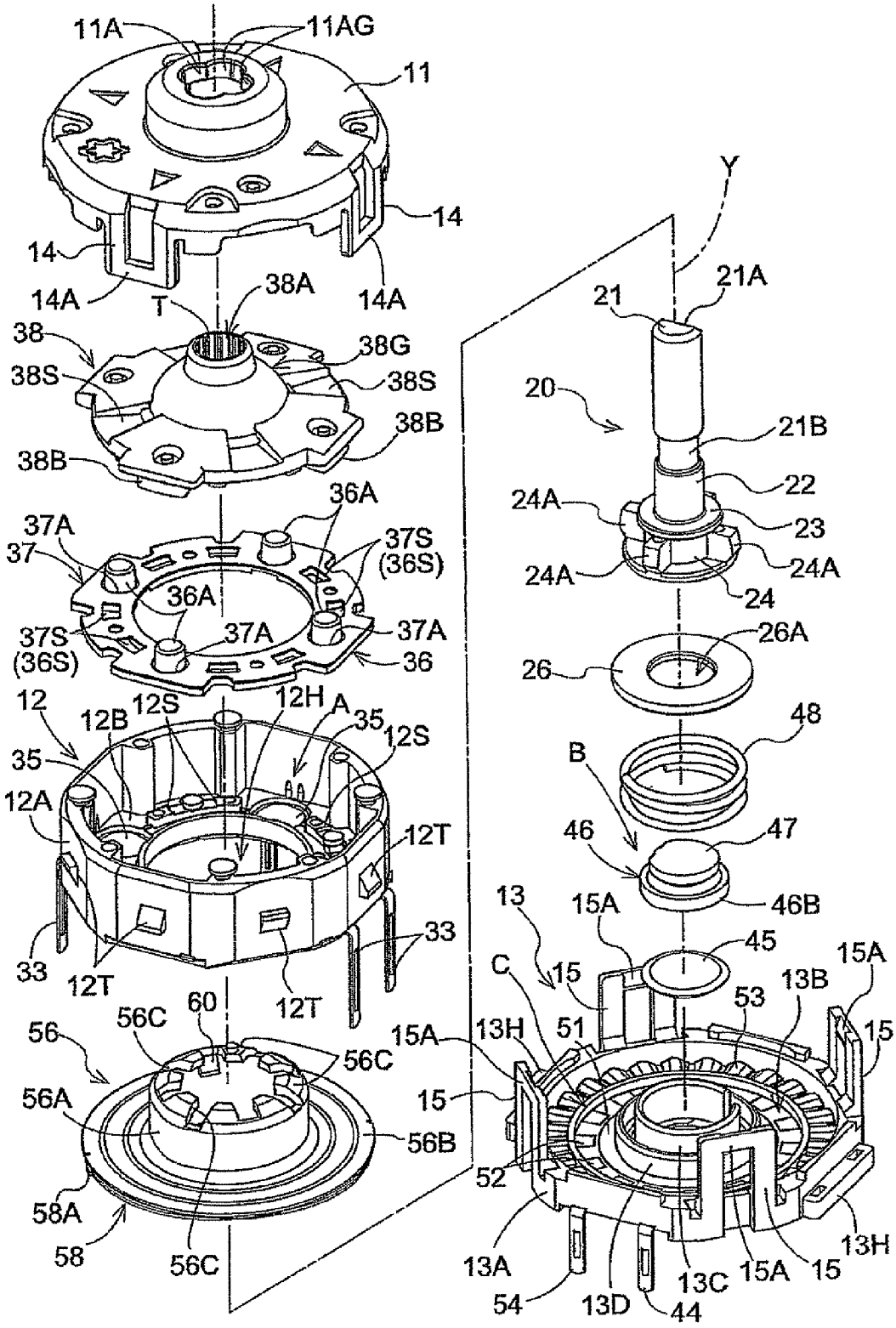
FIG. 4 is a diagram showing an exploded perspective view of the multidirectional switch.

The multidirectional switch may be used in mobile phones, PDAs, game machine controllers, remote controllers for home electronics, and the like. In the multidirectional switch, the vertical direction during use is irrelevant, but in the present embodiment, the upper side in FIG. 3 is referred to as "up," and the lower side is referred to as "down."

The multidirectional switch is configured so that the operating rod 20 maintains a neutral orientation N when not operated. The tilt detector A detects a tilting operation in crosswise directions (four directions) about the neutral orientation N. The axial center of the operating rod 20 is referred to as the axial center Y of the rod, and the pressure detector B electrically detects a pressing operation of the rod in the direction along the axial center Y. The rotation detector C electrically detects the amount of rotational operation about the axial center Y of the rod in the neutral orientation N.

In the multidirectional switch, the tilt detector A is configured to detect operation in four directions when the operating rod 20 has been operated in any of the cross directions, but the tilt detector A may detect a tilt in less than four directions, e.g., two directions, or may detect a tilt in five or more directions, such as eight directions.

The casing 10 has a configuration in which a top cover 11, an upper casing 12, and a lower casing 13, all made of an insulating resin material, are connected to each other. The top cover 11, upper casing 12, and lower casing 13 are molded so that the cross-sectional shape, as viewed along the axial center Y of the rod in the neutral orientation N (plan view), is a regular octagonal shape.

A through-hole 11A through which the operating rod 20 passes in the vertical direction is formed in the top cover 11. A concave-shaped guide surface 11G is formed in the lower surface of the top cover 11 equidistant from the tilt center P of the operating rod 20. Four connecting pieces 14 are integrally and protrudingly formed facing downward on the external peripheral part of the top cover 11, and engaging/connecting parts 14A having a hole shape are formed in the distal ends of the connecting pieces 14.

The through-hole 11A has a structure having a cross-shaped guide groove 11AG along the tilt direction as viewed from above, and a sloped surface facing the direction of the tilt center P is formed in the cross-shaped guide groove 11AG.

Integrally formed in the upper casing 12 is a cylindrical side wall part 12A oriented along the axial center Y of the rod in the neutral orientation N, and an intermediate wall part 12B oriented orthogonal to the axial center Y of the rod in the neutral orientation N. A hole 12H is formed in the center position of the intermediate wall part 12B, and eight concave engaging pieces 12T are formed equidistant in the peripheral direction in the external surface of the side wall part 12A.

Figure 10:
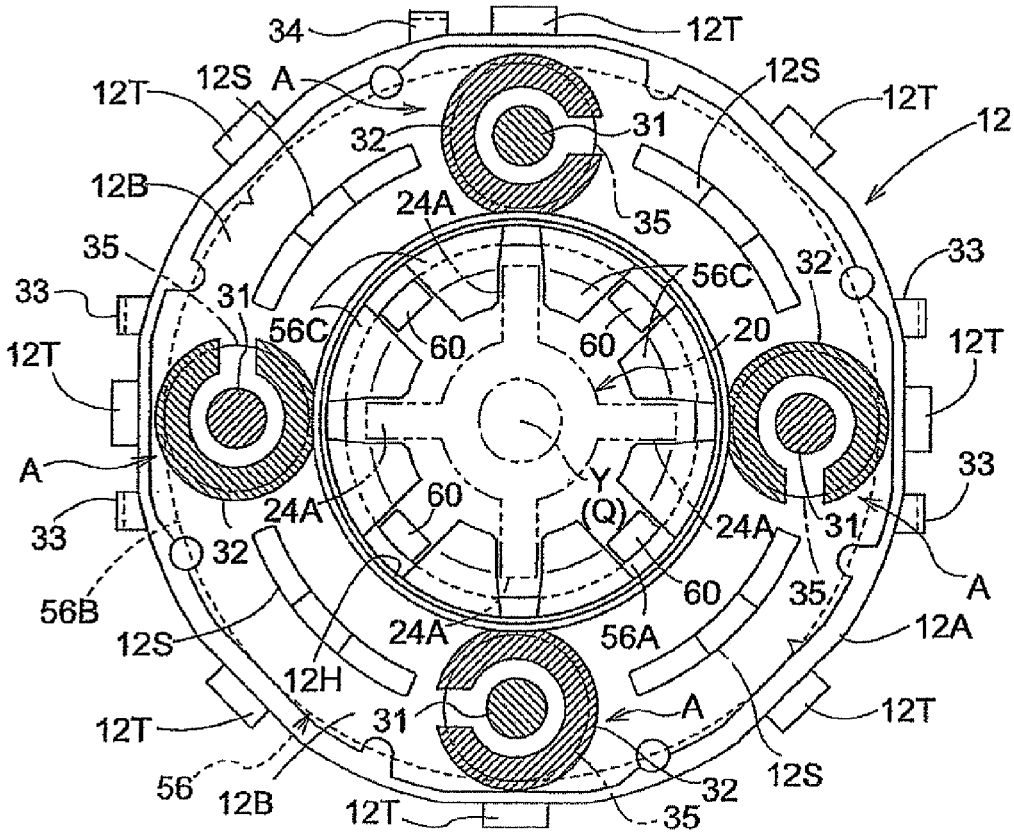
FIG. 10 is a diagram showing a plan view of the electrode arrangement of the intermediate wall part of the upper casing.

A center electrode 31 made of a conductor is formed in four detection positions corresponding to the cross directions in the upper surface of the intermediate wall part 12B of the upper casing 12 about the operating rod 20, as shown in FIG. 10; and ring electrodes 32 made of a conductor are formed in positions that encompass the center electrodes 31.

Independent tilt detection circuits that are conductive separately from the four center electrodes 31, and a common circuit that is conductive to the four ring electrodes 32 are formed in the intermediate wall part 12B of the upper casing 12 by an insert technique. Four tilt detector leads 33 that are conductive to the tilt detection circuits are formed so as to protrude downward on the upper casing 12, and a single common lead 34 that is conductive to the common circuit is formed so as to protrude downward.

Integrally formed in the lower casing 13 are a cylindrical side wall part 13A oriented along the axial center Y of the rod in the neutral orientation N, and a bottom wall part 13B oriented orthogonal to the axial center Y of the rod in the neutral orientation N. A restriction part 13C shaped as a toroidal rib in which the pressure detector B is arranged is concentrically formed so as to protrude in the center of the upper surface of the bottom wall part 13B, and a spring seat part 13D shaped as a toroidal rib is concentrically formed so as to protrude in the external peripheral position.

Four connecting pieces 15 are integrally formed so as to protrude upward on the side wall part 13A of the lower casing 13, and a engaging/connecting parts 15A having a hole shape are formed in the distal ends of the connecting pieces 15.

Figure 7:
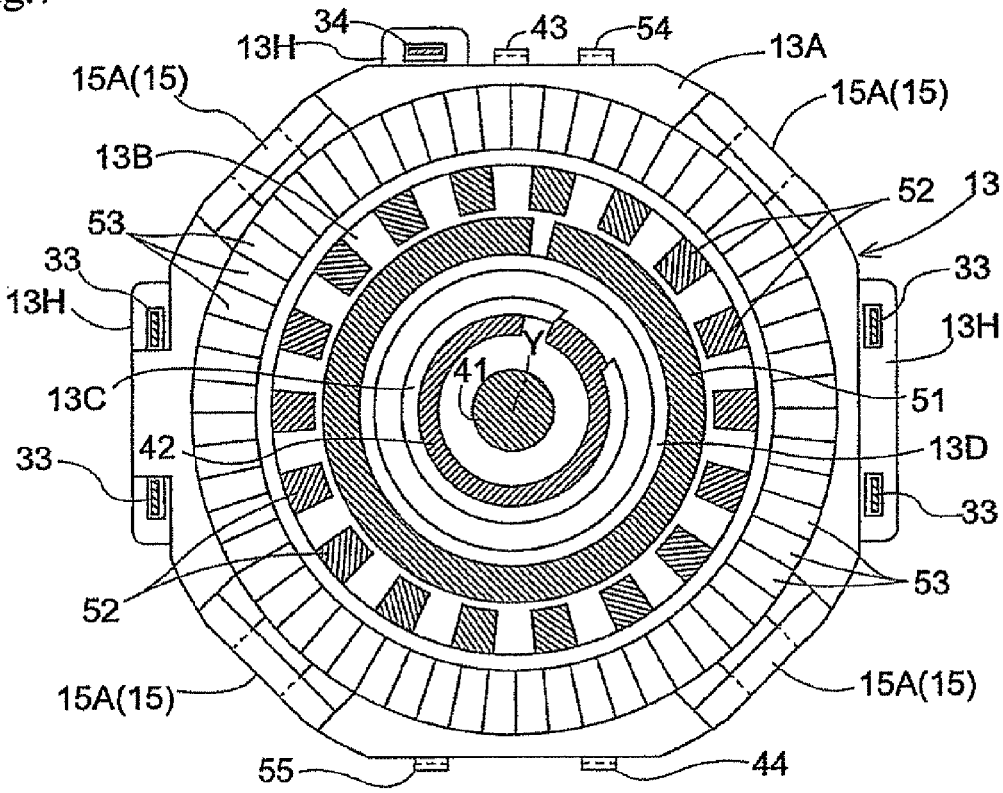
FIG. 7 is a diagram showing a plan view of the electrode arrangement of the bottom wall part of the lower casing.

A center electrode 41 made of a conductor is formed in the center position of the bottom wall part 13B of the lower casing 13 in a location encompassed by the restriction part 13C, and a ring electrode 42 made of a conductor is formed in a position that encompasses the center electrode 41, as shown in FIG. 7. A pressing operation detection circuit that is conductive to the center electrode 41, and a ring circuit that is conductive to the ring electrode 42 are formed on the bottom wall part 13B of the lower casing 13 using an insert technique. A pressure detection lead 43 that is conductive to the pressing operation detection circuit is formed so as to protrude downward, and a ring lead 44 that is conductive to the ring circuit is formed so as to protrude downward.

A ring-shaped common electrode 51 made of a conductor, and a plurality of count electrodes 52 made of a conductor are arranged on the external peripheral portion of the spring seat part 13D of the bottom wall part 13B of the lower casing 13, and numerous clicking-inducing convexities and concavities 53 are formed in positions the encompass the count electrodes 52.

The common electrode 51 is made conductive to a common lead 54 via a circuit formed using an insert technique inside the bottom wall part 13B of the lower casing 13, and the count electrodes 52 are made conductive to a count lead 55 via a circuit formed using an insert technique. The common lead 54 and the count lead 55 are formed so as to protrude downward. A lead holder 13H, provided with a hole through which the four tilt detector leads 33 and the single common lead 34 are inserted, is formed on the lower part of the external surface of the lower casing 13.

(Operating Rod)

The operating rod 20 is made of a copper alloy or another material having relatively high rigidity, and a D-cut part 21A on which a knob or the like is mounted is formed on an upper end part 21 that protrudes upward from the casing 10. A small diameter part 21B and an intermediate part 22 are formed on the lower side of the upper end part 21, and a large diameter part 23 is formed in a location positioned inside the casing 10 below the intermediate part 22.

The small diameter part 21B is set to a diameter that allows entry into the guidance groove 11AG of the top cover 11, an engaging body 24 having a plurality of gear-shaped engaging pieces 24A for outputting a rotational force is connected in a location that protrudes downward from the large diameter part 23, and a contact part 25 is protrudingly formed on the lower end of the engaging body 24. The contact part 25 is molded in the shape of a hemispheric surface that protrudes downward about the tilt center P shown in FIG. 3.

A compression coil spring 48 is provided as an urging member to the spring seat part 13D, and a pressure-receiving member 26 made of resin is arranged between the compression coil spring 48 and the engaging body 24 positioned on the inside end part of the operating rod 20. A hole 26A through which the contact part 25 is inserted is formed in the central position of the pressure-receiving member 26. The pressure-receiving member 26 determines the tilt limit by making contact with a plurality of protruding pieces 60 formed on the internal surface of a cylindrical part 56A of a later-described rotor 56.

In particular, an urging axial center Q (a virtual straight line connecting the center of a circle drawn by the coil) of the compression coil spring 48 is arranged to be coaxial with the axial center Y of the operating rod 20 in the neutral orientation N. The pressure-receiving member 26 is thereby freely movable along the urging axial center Q, and the tilt limit is determined by making contact with the plurality of protruding pieces 60.

(Tilt Detector)

The tilt detector A has center electrodes 31 formed in four locations of the intermediate wall part 12B of the upper casing 12 as described above, a ring electrode 32, a dome-shaped spring material 35 made of a conductor arranged in a position that covers the electrodes, a rubber ring 36 integrally formed with a cushioning body 36A in contact with the upper surface of the four spring plate members 35, a spring ring 37 made of a ring-shaped spring material arranged in close contact with the upper surface of the rubber ring 36, and an acting body 38 for causing a pressing force to act on the spring plate members 35 via the cushioning body 36A when the operating rod 20 is tilted.

The spring plate members 35 are discoid elements made of a copper alloy, an iron alloy, or another conductor, and have a center part that is formed in the shape of an upwardly bulging dome. The periphery of the spring plate members 35 is in contact with the ring electrode 32 when a pressing force is not applied, and the center part is set at a distance from the center electrode 31.

When a pressing force acts on the center part of a spring plate member 35 from above, the center part of the spring plate member 35 undergoes elastic deformation and makes contact with the center electrode 31, whereby the center electrode 31 and the ring electrode 32 are placed in a conductive state. A structure is shown in the diagram in which a single spring plate member 35 is arranged in a detection position, but a plurality of spring plate members 35 may be used.

The rubber ring 36 is made of silicone rubber or another soft insulating material, and the cushioning body 36A is integrally formed in a configuration that protrudes in four locations of the front and back surfaces of the rubber ring 36. A hole 37A through which the cushioning body 36A is passed is formed in the spring ring 37. In a similar manner, fitting holes 36S, 37S are formed in the rubber ring 36 and the spring ring 37, and a fitting piece 12S protruding into the intermediate wall part 12B is fitted into the fitting holes 36S, 37S, whereby the rubber ring 36 and the spring ring 37 are supported in proper positions.

The acting body 38 has a hole 38A formed in the center by molding from an insulating resin material, a convex sliding-contact surface 38G that slidably contacts the guide surface 11G formed on the lower surface of the top cover 11 is formed on the upper surface in the center, and four pressure-operated parts 38B are formed so as to protrude downward on the external peripheral portion.

A plurality of grooves T is formed on the internal peripheral surface of the hole 38A parallel to the axial center Y of the operating rod 20, and the operating rod 20 is inserted into the hole 38A. Since only the protruding locations of the internal surface of the hole 38A make contact with the operating rod 20 in a state in which the intermediate part 22 of the operating rod 20 is fitted onto the operating rod 20, the contact surface area with the operating rod 20 can be reduced, and the relative rotation of the rod about the axial center Y and the relative sliding movement of the rod in the direction of the axial center Y can be facilitated. The sliding-contact surface 38G is formed on a portion of the smooth spherical surface at an equidistant point from the tilt center P of the operating rod 20 to provide a smooth stable tilt.

Four concavities 38S are formed in the vicinity of the external periphery of the upper surface of the acting body 38, and the relative positional relationship between the pressure-operated parts 38B of the acting body 38 and the detection positions are properly maintained by fitting the concavities 38S onto the positioning pieces (not shown) protrudingly formed on the lower surface of the top cover 11.

(Pressure Detector)

The pressure detector B has a center electrode 41 formed in the bottom wall part 13B of the lower casing 13, a ring electrode 42, a dome-shaped spring plate member 45 arranged in a position covering the electrodes, a first contact member 46 arranged on the upper part of the spring plate member 45, and a second contact member 47 fitted and connected to the first contact member.

The spring plate member 45 is a discoid material made of a copper alloy, an iron alloy, or another conductor, and has a center part that is formed in the shape of an upwardly bulging dome in the same manner as the tilt detector. The periphery of the spring plate member 45 is in contact with the ring electrode 42 when a pressing force is not applied, and the center part is set at a distance from the center electrode 41.

The center part of the spring plate member 45 makes contact with the center electrode 41 by elastic deformation when a pressing force acts on the spring plate member 45 from above, whereby the center electrode 41 and the ring electrode 42 are placed in a conductive state. A structure is shown in the diagram in which a single spring plate member 45 is arranged, but a plurality of spring plate members 45 may also be used.

The first contact member 46 on the lower side is formed from silicone rubber or another relatively soft insulating resin material, the second contact member 47 on the upper side is formed from a relatively hard insulating resin material, and the first contact member 46 and the second contact member 47 are fitted and connected together. The first contact member 46 on the lower side is freely operable in the vertical direction while guided along the internal surface of the restriction part 13C, and a concave surface is formed on the upper surface of the second contact member 47 on the upper side so as to follow the shape of the contact part 25 of the lower end of the operating rod 20, thereby providing a function in which pressure from the contact part 25 is transferred to the spring plate member 45 via the first contact member 46, even when the operating rod 20 is slightly tilted.

The rib-shaped restriction part 13C is set so as to protrude from the bottom wall part 13B of the lower casing 13 so that contact is made with the pressure-receiving member 26 after the pressure detector B has reached a detection state due to the pressing force from the operating rod 20 when the operating rod 20 has been operated by pressure.

(Rotation Detector)

Figure 8:
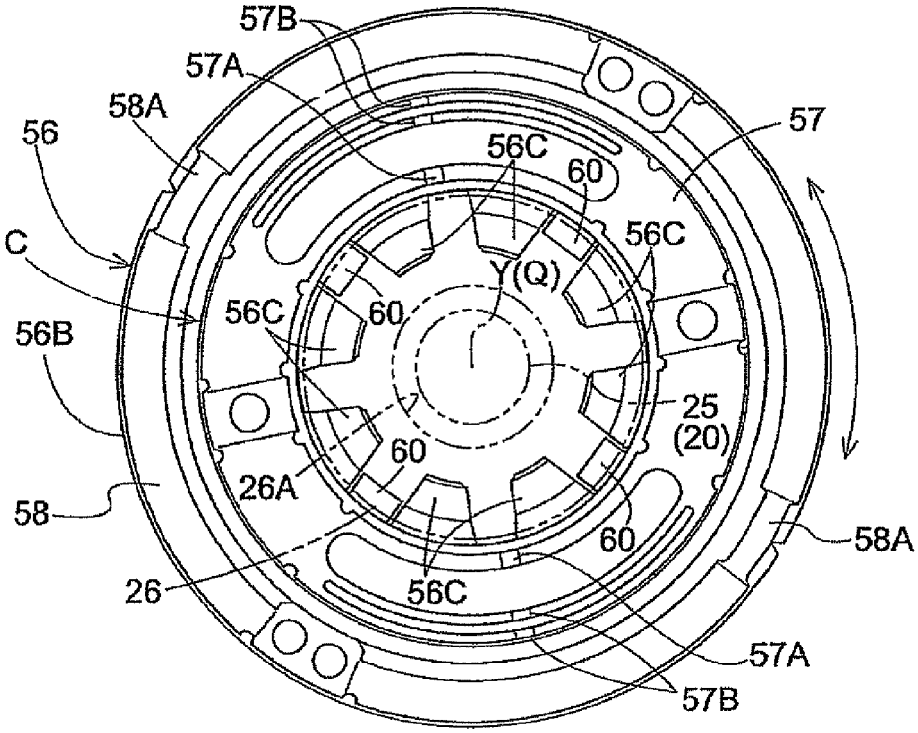
FIG. 8 is a diagram showing a bottom view of the rotor.
Figure 9:
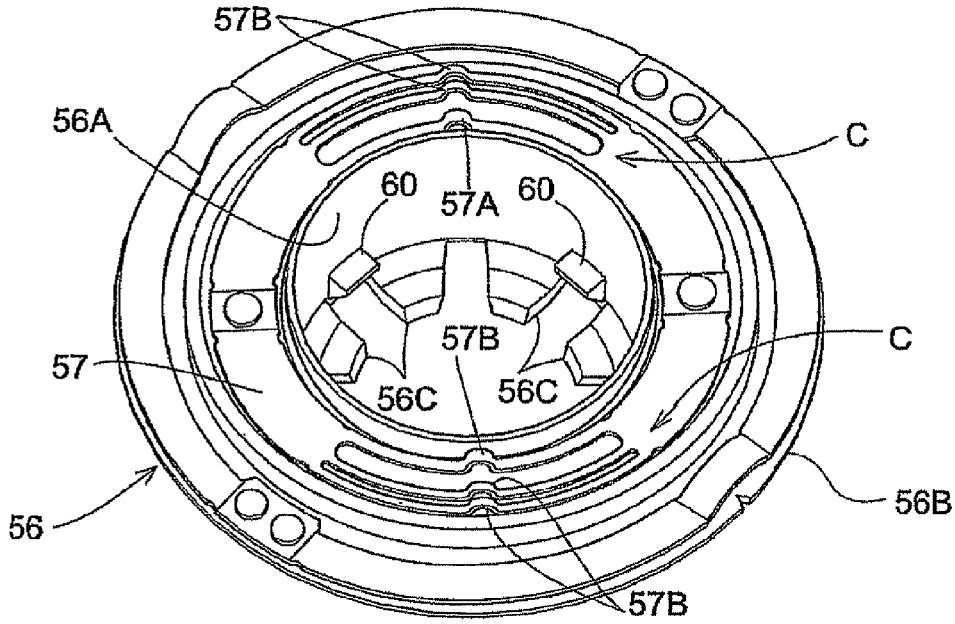
FIG. 9 is a diagram showing a perspective view of the rotor.

The rotation detector C has a rotor 56 to which rotational force is transmitted from a plurality of gear-shaped engaging pieces 24A of the engaging body 24 formed in an inside end position of the operating rod 20, a contact 57 formed on the lower surface of the rotor 56, as shown in FIGS. 8 and 9, and a click spring 58 formed on the lower surface of the rotor 56.

The rotor 56 is molded using an insulating resin material, whereby a cylindrical part 56A is formed in the center part, and a flange-shaped part 56B is integrally formed at the lower end of the cylindrical part 56A. Groove-shaped engaging parts 56C fitted with the engaging pieces 24A are formed on the upper end of the cylindrical part 56A. The engaging parts 56C are configured so as to allow the gear-shaped engaging body 24 to tilt in accompaniment with the tilting of the operating rod 20.

Four engaging parts 56C are formed in the circumferential direction on the upper part of the cylindrical part 56A, as shown in FIGS. 3 to 6 and FIGS. 8 to 10. Protruding pieces 60 are formed so as to protrude into the cylindrical part 56A in an intermediate position in the circumferential direction of each of the engaging parts 56C.

The outside diameter of the cylindrical part 56A of the rotor 56 is set to a value that allows the part to be inserted into the hole 12H formed in the upper casing 12, and the inside diameter of the lower end part of the cylindrical part 56A is set to a value that is slightly greater than the outside diameter of the spring seat part 13D of the lower casing 13. The external surface of the cylindrical part 56A of the rotor 56 is thereby caused to make light contact with the internal surface of the hole 12H formed in the upper casing 12 in the assembled state of the multidirectional switch. At the same time, the internal surface of the lower end part of the cylindrical part 56A makes light contact with the spring seat part 13D of the lower casing 13 to provide stable rotation in a configuration in which the internal surface of the hole 12H and the external surface of the spring seat part 13D serve as guides during rotation of the rotor 56.

The downward protruding rib is formed on the lower surface of the flange-shaped part 56B of the rotor 56, and the distance between the lower end of the rib and the upper surface of the flange-shaped part 56B is set to a value that is slightly less that the dimension in the vertical direction of the space formed by the lower casing 13. The upper surface of the flange-shaped part 56B of the rotor 56 is thereby caused to make light contact with the lower surface of the intermediate wall part 12B of the upper casing 12 with the multidirectional switch being assembled to allow the rotor 56 to rotate with greater stability.

The contact 57 is a copper alloy or another conductor molded in a ring shape, and has a structure in which a primary sliding-contact part 57A in constant contact with the common electrode 51 is formed on the internal periphery of the contact, and a secondary sliding-contact part 57B capable of sliding on the count electrodes 52 is formed in a specific position in the circumferential direction on the external periphery. In such a structure, the count electrodes 52 and the common electrode 51 reach a conductive state when the secondary sliding-contact part 57B on the external periphery of the contact 57 makes contact with the count electrodes 52 during rotation of the rotor 56, and the count electrodes 52 and the common electrode 51 are brought to an insulating state when the secondary sliding-contact part 57B is separated from the count electrodes 52.

The click spring 58 is shaped as a ring from a soft elastically deformable metal material, and the spring has a structure in which a downwardly protruding part 58A is provided in two locations in the circumferential direction. During rotation of the rotor 56, the protruding part 58A engages and disengages from the clicking-inducing convexities and concavities 53 in the bottom wall part 13B of the lower casing 13, producing a clicking sensation.

(Detection Configuration)

Figure 5:
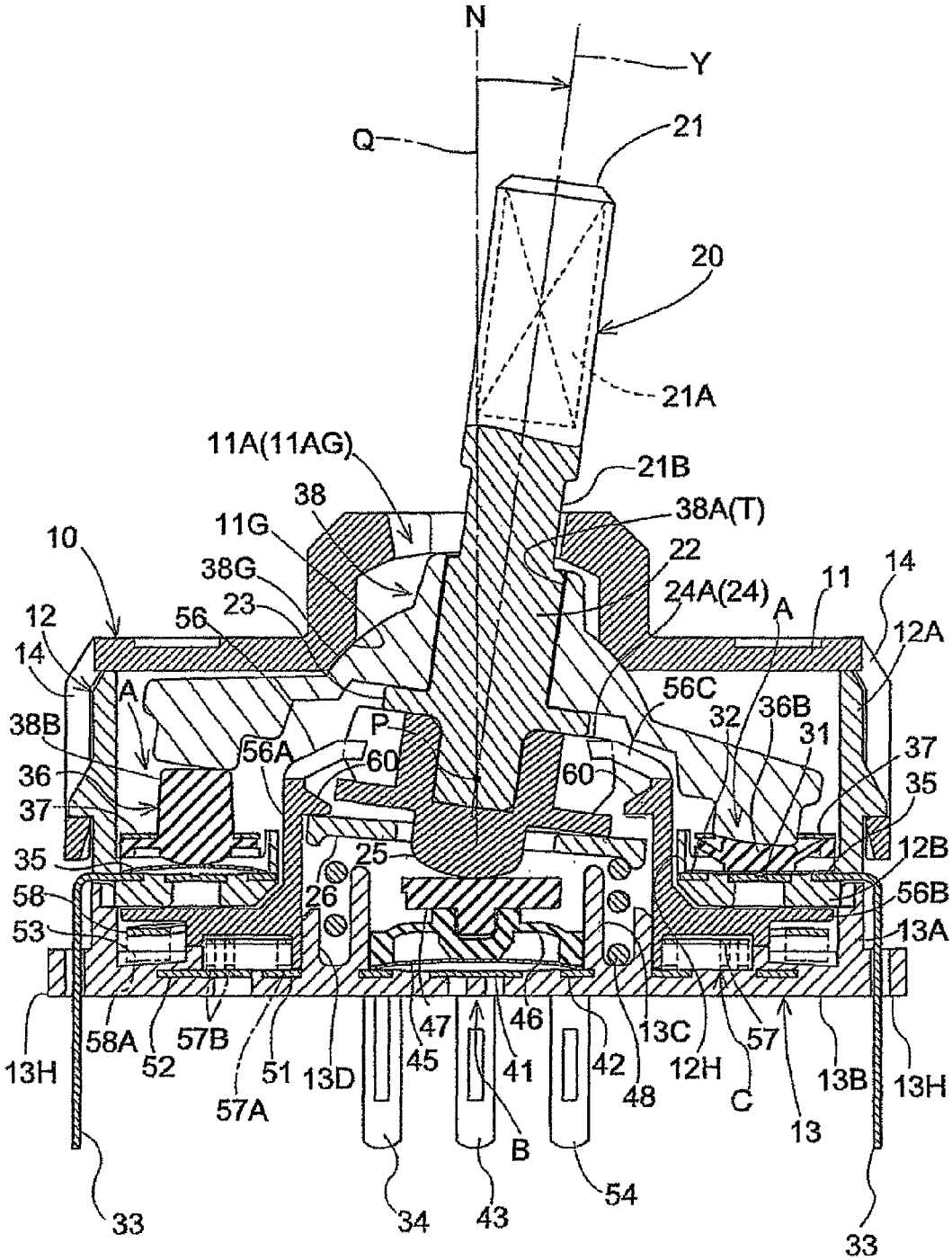
FIG. 5 is a diagram showing a longitudinal sectional view of the multidirectional switch in a tiltably operated state.

When the operating rod 20 has been tiltably operated in any direction about the neutral orientation N in a state in which voltage is applied to any one of the four tilt detector leads 33 and the single common lead 34, the acting body 38 tilts in accompaniment with the tilting of the operating rod in the manner shown in FIG. 5, and a pressing force acts from the pressure-operated parts 38B of the acting body 38 via the cushioning body 36A onto the spring plate member 35 positioned in the corresponding direction, whereby the spring plate member 35 can be elastically deformed, the center electrode 31 and the ring electrode 32 can be rendered conductive, and the tilting operation can be brought out as a change in the voltage signal of the corresponding tilt detector lead 33.

In a case in which the operating rod 20 has been tiltably operated in this manner, the sliding-contact surface 38G of the acting body 38 supported by the operating rod 20 moves along the guide surface 11G formed on the lower surface of the top cover 11, whereby the operating rod 20 is made to tilt about the tilt center P. A clicking sensation is produced when the corresponding spring plate member 35 undergoes elastic deformation in the tilting direction in accompaniment with the tilting operation, and the operator can perceive that the tilting operation has been detected. Since the pressing force from the pressure-operated parts 38B of the acting body 38 operates via the cushioning body 36A during the tilting operation, the cushioning body 36A undergoes compression deformation under a strong pressing force, whereby unwanted damage from the strong force acting on the spring plate member 35 can be avoided. The operating rod 20 is restored to a neutral orientation N by the urging force from the spring ring 37 and the compression coil spring 48 when the tilting operation has ended and the tilting operation of operating rod 20 is released.

In particular, a portion of the external periphery of the bottom surface of the engaging body 24 makes contact with external periphery of the pressure-receiving member 26, and a force that causes the pressure-receiving member 26 to tilt is applied, in a case in which the operating rod 20 has been tiltably operated. However, tilting and upward movement of the pressure-receiving member 26 are restricted by the protruding pieces 60. Therefore, the protruding pieces 60 prevent a situation in which the location on the opposite side from the location in contact with the engaging body 24 is lifted up, and the pressure-receiving member 26 maintains a substantially horizontal orientation without considerable tilting, as shown in FIG. 5. A situation can thereby be avoided in which an urging force acts from the compression coil spring 48 in a direction offset from the operating rod 20. Furthermore, when the operating rod 20 is tiltably operated, the pressure-receiving member 26 and the bottom surface of the engaging body 24 of the lower end of the operating rod 20 make contact on the pressing side, but the other bottom surface of the engaging body 24 move away. Therefore, only the urging force from the compression coil spring 48 acts from the contact location in the direction that restores the operating rod 20, and restorative force is increased.

Figure 6:
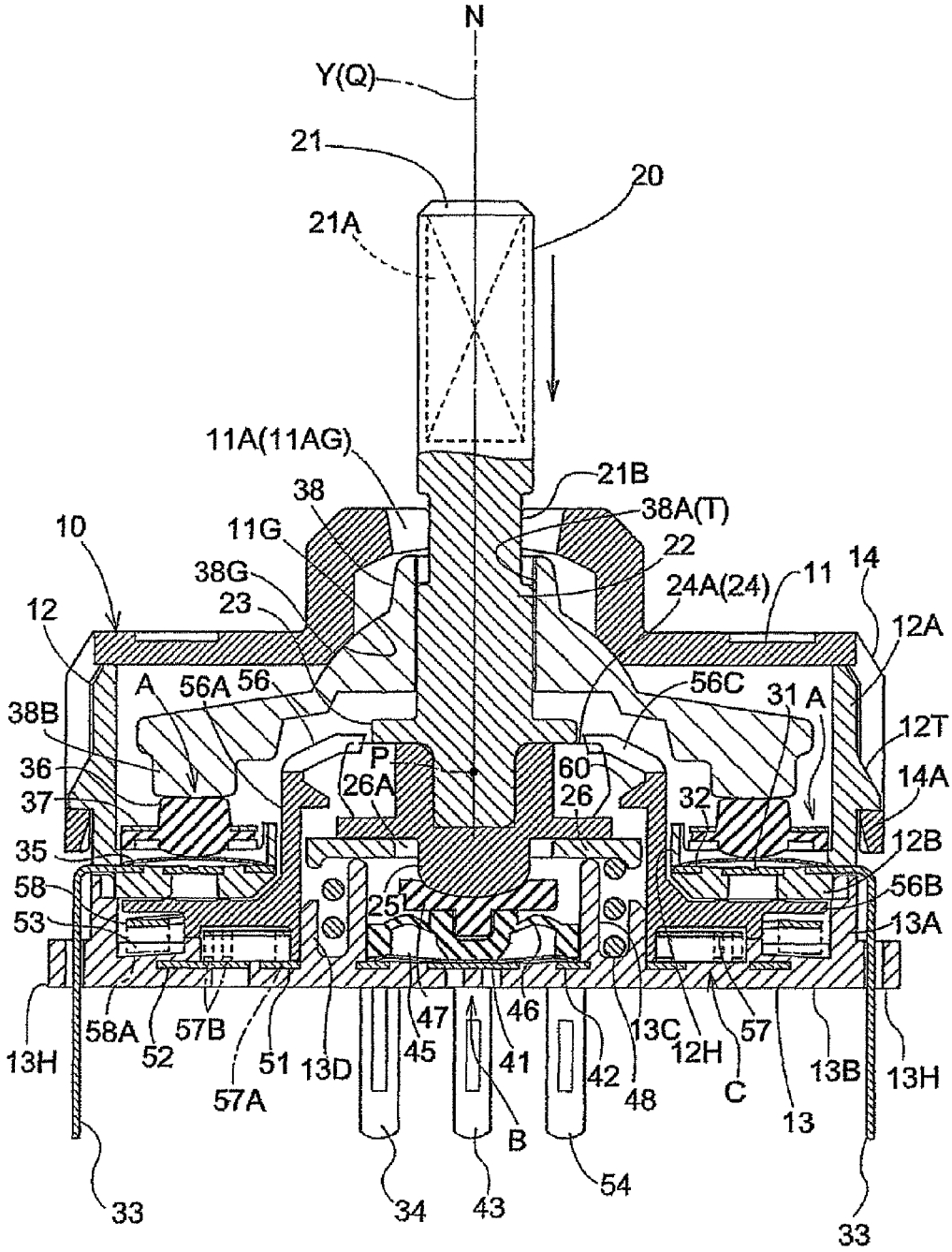
FIG. 6 is a diagram showing a longitudinal sectional view of the multidirectional switch operated by pressure.

As shown in FIG. 6, the operating rod 20 moves along the axial center Y of the rod when the operating rod 20 is operated by pressure in a state in which voltage is applied to the pressure detection lead 43 or to the ring lead 44. Pressure from the operating rod 20 acts on the spring plate member 45 via the first contact member 46 and the second contact member 47 in accompaniment with the movement, the spring plate member 45 undergoes elastic deformation, the center electrode 41 and the ring electrode 42 are placed in a conductive state, and the pressing operation is brought out as a voltage signal of the pressure detection lead 43.

When the operating rod 20 has been operated by pressure in this manner, a clicking sensation is produced when the spring plate member 45 undergoes elastic deformation, and the operator can been made to perceive that the pressing operation has been detected. When the operating rod 20 has been operated by pressure, the spring plate member 45 undergoes elastic deformation, the center electrode 41 and the ring electrode 42 are placed in a conductive state, and the pressure-receiving member 26 of the operating rod 20 makes contact with the rib-shaped restriction part 13C immediately thereafter. Since the first contact member 46 is soft and is elastically deformed, unwanted damage in which excessive force acts on the center electrode 41, the ring electrode 42, or the spring plate member 45 can be avoided even when strong pressure has been applied to the operating rod 20.

The operating rod 20 is ideally in the neutral orientation N when the operating rod 20 is operated by pressure, but the operating rod 20 can also be operated by pressure in a slightly tilted state. In particular, when the operating rod 20 is significantly tilted, the location of the pressure-receiving member 26 of the lower end of the operating rod 20, which protrudes downward the most because of the tilting, makes contact with the restriction part 13C state in which the operating rod 20 is considerably tilted, whereby a force is applied so as to urge the operating rod 20 toward the neutral orientation N, and a pressing operation is performed in which the operating rod 20 in made to approach the neutral orientation N.

Furthermore, in a state in which voltage is applied to the common electrode 51 or the count electrodes 52, the count electrodes 52 and the common electrode 51 are placed in a conductive state when the secondary sliding-contact part 57B of the external periphery of the contact 57 makes contact with the count electrodes 52 in accompaniment with the rotation of the rotor 56 in a case in which the operating rod 20 has been rotatably operated, and the count electrodes 52 and the common electrode 51 are brought to an insulating state when the secondary sliding-contact part 57B is separated from the count electrodes 52. As a result, the voltage of the count lead 55 is reversed. The change in the voltage signal is counted (numbered) on a board or the like external to the multidirectional switch each time the voltage changes in this manner. The rotational distance of the operating rod 20 relative to the initial rotation orientation can thereby be ascertained (the device can function as an incremental rotary encoder).

The protruding part 58A of the click spring 58 engages and disengages from the convexities and concavities 53 when the operating rod 20 is rotatably operated, and rotation can be ascertained by a clicking sensation from the operating rod 20.

Effect of the Embodiment

In accordance with this invention, a tilting operation of an operating rod 20 is electrically detected by a tilt detector A, a pressing operation of the operating rod 20 in the direction along the axial center Y is electrically detected by a pressure detector B, and a rotational operation about the axial center Y of the operating rod 20 is electrically detected by a rotation detector C.

In a case in which the operating rod 20 is not operating, the operating rod 20 can be kept in a neutral orientation N by the urging force exerted by the spring plate member 35 and rubber ring 36, which constitute the tilt detector A, in the direction of the neutral orientation N, and by the urging force from the compression coil spring 48. In a case in which the operating rod 20 is tiltably operated from the neutral orientation N, pressure acts on the external periphery of the compression coil spring 48 (external periphery of the coil) from the external peripheral part of the engaging body 24 of the inside end of the operating rod 20 via the pressure-receiving member 26.

In a situation in which a biased force acts on the compression coil spring 48 in this manner, stretching deformation is induced in the external periphery (external periphery of the coil) on the other side from the pressure-acting position across the urging axial center Q. However, the protruding pieces 60 restrict the lifting of the pressure-receiving member 26 in a location that extends in this manner, whereby the pressure-receiving member 26 is caused to maintain a substantially horizontal orientation (an orientation orthogonal to the urging axial center Q). Therefore, it is possible to avoid an undesirable situation in which the restorative force of the operating rod 20 is reduced and in which the switch is less convenient to operate by the operating rod 20 during the operation.

Other Embodiments

In addition to the embodiment described above, the present invention may have a configuration in which, e.g., restricting pieces that protrude outward are formed in a plurality of locations of the external periphery of the pressure-receiving member 26, a plurality of slits or grooves is formed in the cylindrical part of the rotor 56 along the perpendicular direction so as to allow entry of the restricting pieces, and the restricting pieces make contact with an upper end position of the slits or grooves to make it possible to set the tilt limit of the urging force exerted by the urging member (compression coil spring 48).

In such a configuration, the restricting pieces make contact with the upper end of the slits or grooves to prevent a situation in which the location on the side opposite from the location in contact with the engaging body 24 is lifted up, even in a situation in which a portion of the external peripheral part of the bottom surface of the engaging body 24 makes contact with the external peripheral part of the pressure-receiving member 26 and a force is applied to tilt the pressure-receiving member 26, as in a case in which the operating rod 20 is tiltably operated. This is a result of the pressure-receiving member 26 being restricted from moving upward by the contact of the restricting pieces with the upper end of the slits or grooves. As a result, the pressure-receiving member 26 substantially maintains a horizontal orientation without greatly tilting, and a situation can be avoided in which the urging force operates on the operating rod 20 in a biased direction from the compression coil spring 48.

INDUSTRIAL APPLICABILITY

The present invention can be used as a multidirectional switch having a tilt detector for electrically detecting a tilting operation of an operating rod supported in a casing, a pressure detector for electrically detecting a pressing operation of the operating rod in a direction along an axial center, and a rotation detector for electrically detecting a rotational operation of the operating rod.

What is claimed is:

1. A multidirectional switch provided with a tilt detector for electrically detecting a tilting operation of an operating rod supported in a casing, a pressure detector for electrically detecting a pressing operation of the operating rod in a direction along an axial center, and a rotation detector for electrically detecting a rotational operation of the operating rod, the multidirectional switch comprising:

an urging member for applying an urging force to the operating rod along an urging axial center that is coaxial with the axial center of the operating rod in a neutral orientation in the direction of the tilting operation;

a pressure-receiving member tiltable relative to the operating rod and caused to make contact with an inside end part of the operating rod inside the casing by the urging force from the urging member; and a cylindrical part capable of engaging and integrally rotating with the external periphery of an inside end part of the operating rod, the urging member and the pressure-receiving member being arranged inside the cylindrical part, and protruding pieces are formed on the internal surface of the cylindrical part, wherein:

the pressure-receiving member has a tilt limit during the tilting operation of the operating rod by making contact with the protruding pieces.

2. The multidirectional switch of claim 1, wherein a hole is formed in a central portion of the pressure-receiving member through which a contact part protruding from an inner end part of the operating rod is inserted.

3. The multidirectional switch of claim 2, wherein:

the rotation detector has a rotor for rotating in accompaniment with the operating rod, and a plurality of electrodes for detecting the rotational position of the rotor, and the cylindrical part is formed in the rotor.

4. The multidirectional switch of claim 1, wherein:

the pressure detector has a spring plate member made of a conductor elastically deformed by the effect of a pressing force produced by the operation of the operating rod in an inward pressing direction, and also has a pair of electrodes energized by contact with the spring plate member when the spring plate member undergoes elastic deformation;

the urging member is made of a compression coil spring; and the compression coil spring is arranged in a position that encompasses the spring plate member.

5. The multidirectional switch of claim 1, wherein the tilt detector has elements arranged in positions encompassing the operating rod, the elements comprising:

an acting body for integrally tilting with the operating rod;

a spring plate member made of a conductor elastically deformed by the effect of a pressing force produced by the acting body; and a pair of electrodes energized by contact with the spring plate member when the spring plate member undergoes elastic deformation.

6. The multidirectional switch of claim 2, wherein:

the pressure detector has a spring plate member made of a conductor elastically deformed by the effect of a pressing force produced by the operation of the operating rod in an inward pressing direction, and also has a pair of electrodes energized by contact with the spring plate member when the spring plate member undergoes elastic deformation;

the urging member is made of a compression coil spring; and the compression coil spring is arranged in a position that encompasses the spring plate member.

7. The multidirectional switch of claim 3, wherein:

the pressure detector has a spring plate member made of a conductor elastically deformed by the effect of a pressing force produced by the operation of the operating rod in an inward pressing direction, and also has a pair of electrodes energized by contact with the spring plate member when the spring plate member undergoes elastic deformation;

the urging member is made of a compression coil spring; and the compression coil spring is arranged in a position that encompasses the spring plate member.

8. The multidirectional switch of claim 2, wherein the tilt detector has elements arranged in positions encompassing the operating rod, the elements comprising:

an acting body for integrally tilting with the operating rod;

a spring plate member made of a conductor elastically deformed by the effect of a pressing force produced by the acting body; and a pair of electrodes energized by contact with the spring plate member when the spring plate member undergoes elastic deformation.

9. The multidirectional switch of claim 3, wherein the tilt detector has elements arranged in positions encompassing the operating rod, the elements comprising:

an acting body for integrally tilting with the operating rod;

a spring plate member made of a conductor elastically deformed by the effect of a pressing force produced by the acting body; and a pair of electrodes energized by contact with the spring plate member when the spring plate member undergoes elastic deformation.

* * * * *